United States Patent [19]

Bowsky et al.

[11] Patent Number: 4,786,762

[45] Date of Patent: Nov. 22, 1988

[54] SLEEVE ARRANGEMENT FOR A HERMETIC TERMINAL ASSEMBLY

[75] Inventors: Benjamin Bowsky, Warren County; Larry G. Burrows, Hamilton County; Glenn A. Honkomp, Warren County, all of Ohio

[73] Assignee: Emerson Electric Co., St. Louis, Mo.

[21] Appl. No.: 163,541

[22] Filed: Mar. 3, 1988

[51] Int. Cl.[4] ..... H01B 17/30

[52] U.S. Cl. ..... 174/152 GM; 439/935

[58] Field of Search ..... 174/50.61, 152 GM; 439/926, 935

[56] References Cited

U.S. PATENT DOCUMENTS 4,292,464 9/1981 Vogt et al. ..... 174/152 GM
4,296,275 10/1981 Bowsky ..... 174/152 GM
4,461,925 7/1984 Bowsky et al. ..... 174/152 GM
4,580,003 4/1986 Bowsky et al. ..... 174/152 GM
4,584,433 4/1986 Bowsky et al. ..... 174/152 GM

*Primary Examiner*—Laramie E. Askin
*Attorney, Agent, or Firm*—Polster, Polster and Lucchesi

[57] ABSTRACT

A hermetic terminal assembly for a motor unit housing including a cup-shaped body, the bottom of which has a rim and at least one hole defining an annular sealing lip extending in the same direction therefrom through which hole an electrical connection pin extends in sealed relation thereto with the pin insulated by a protective insulating extension sleeve bonded to a sealing insulator, the extension sleeve being formed relative the sealing insulator member and lip extremity to contact the outer periphery of the lip to remove possible sealing insulator cracking to a position removed from the pin.

10 Claims, 2 Drawing Sheets

SLEEVE ARRANGEMENT FOR A HERMETIC TERMINAL ASSEMBLY

BACKGROUND OF THE INVENTION

The present invention relates to hermetic terminal assemblies and more particularly to an improved insulating sleeve arrangement for conducting pins of a hermetic terminal assembly such as U.S. Pat. No. 4,296,275, issued to Benjamin Bowsky on Oct. 20, 1981; U.S. Pat. No. 4,461,925, issued to Benjamin Bowsky et al, on July 24, 1984; U.S. Pat. No, 4,580,003, issued to Benjamin Bowsky et al, on Apr. 1, 1986; and U.S. Pat. No. 4,584,433, issued to Benjamin Bowsky et al, on Apr. 22, 1986.

In the aforementioned patents at least one conducting pin is passed through a hole for such pin in the bottom of a cup-shaped body, with the hole being defined by an annular lip extending in the same direction as a rim of the cup-shaped body. A material is provided to seal the pin to the inner wall of the annular lip forming a sealing insulator therebetween; and a protective extension sleeve surrounding the pin is bonded to the sealing insulator.

In accordance with the present invention, it is recognized that prior art hermetic terminal assembly arrangements which have included a sealed, insulated conducting pin and protective ceramic extension sleeve adjacent thereto, on occasion have been encumbered with problems of sealing insulator cracking. It further is recognized by the present invention that such undesirable cracking often includes that area immediately adjacent the conducting pin with the cracking initiating where the protective ceramic extension sleeve contacts the annular lip and then migrating through the sealing insulator to the proximate conducting pin. This undesirable cracking has resulted in loss of electrical oversurface or leakage. Recognizing the cause and effect of these past undesirable cracking problems, the present invention provides a novel and unique hermetic terminal assembly which, in an efficient, straightforward and economical manner, serves to localize undesirable sealing insulator cracking, which might be brought about by sealing insulator, ceramic extension sleeve and annular lip contact, to an area remote from the sealed pin so as to minimize the risk of extensive reduction in electrical properties and concomitant loss of hermeticity. In addition, the present invention provides an improved, modified hermetic terminal assembly arrangement which not only provides for remote localization of such possible undesirable sealing insulator cracking but, in addition, provides an economical to manufacture and assemble extension sleeve of a universal nature with respect to the opposite ends thereof. Furthermore, the unique structure of the present invention accomplishes this in a straightforward, efficient and economical manner.

Various other features of the present invention will become obvious to one skilled in the art upon reading the disclosure set forth hereinafter.

SUMMARY OF THE INVENTION

More particularly, the present invention provides a hermetic terminal assembly adapted to be secured to an opening in a motor unit housing comprising: a cup-shaped body with a bottom and rim extending in one direction therefrom, the bottom having at least one hole defined by an annular sealing lip projecting in the direction of the rim; a conducting pin extending through the hole with the outer end adapted to be connected to a current source and the inner end adapted to be connected to a housed motor unit; a sealing insulator bonding the pin to the inside surface of the lip; and, an electrically insulating extension sleeve surrounding the pin with an end portion nesting with the hole defined by the lip to engage with and be bonded to the sealing insulator, the nesting end portion of the extension sleeve being so sized and configured that the wall of the extension sleeve abuttingly engages the end portion of the annular lip only along the outer periphery thereof in substantial line contact therewith to localize possible sealing insulator cracking which might occur adjacent the abutting contact of extension sleeve and lip to a position remote from the conducting pin. In addition, the present invention provides a novel bonding arrangement which embeds the extension sleeve in the sealing insulator, as well as a novel arrangement wherein either extension sleeve end can be utilized to abut the annular lip of the cup-shaped body.

It is to be understood that various changes can be made by one skilled in the art in one or more of the several parts of the apparatus disclosed herein without departing from the scope or spirit of the present invention.

BRIEF DESCRIPTION OF THE DRAWINGS

Referring to the drawings which disclose one advantageous embodiment of the inventive terminal assembly and a modified sleeve arrangement therefor.

DETAILED DESCRIPTION OF THE DRAWINGS

Figure 2:
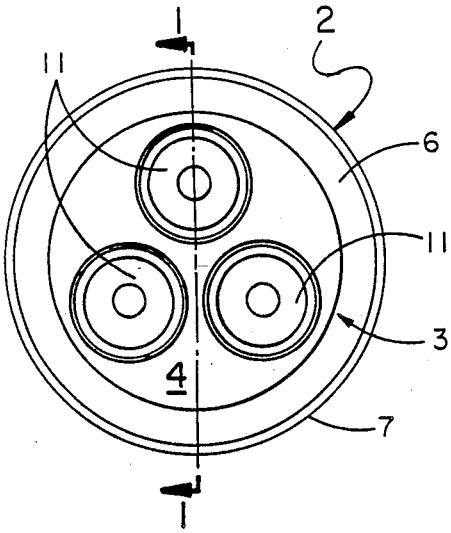
FIG. 2 is an end view of the assembly of FIG. 1 taken in a plane through line 2—2 of FIG. 1.
Figure 1:
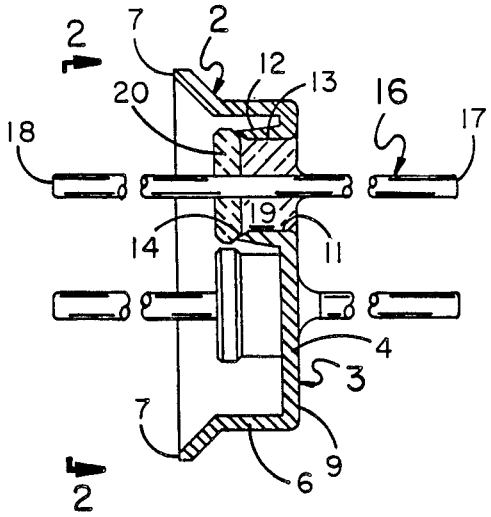
FIG. 1 is a view, partly in section and partly broken away along line 1—1 of FIG. 2, of the inventive terminal assembly disclosing the novel sealing insulator, extension sleeve and pin arrangement.
Figure 3:
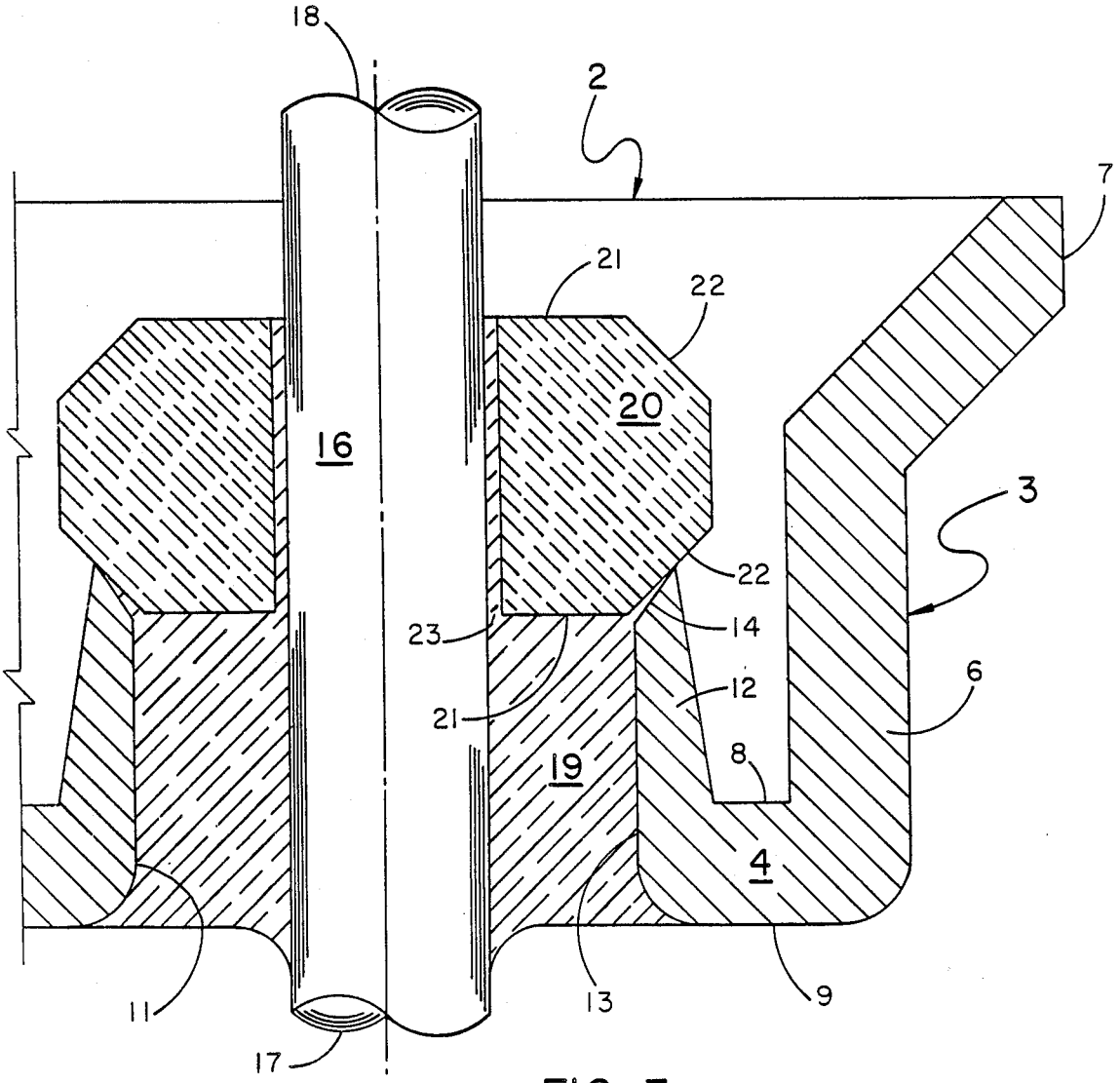
FIG. 3 is an enlarged view of a portion of FIG. 1 to more fully disclose the inventive structure, particularly the manner in which an end portion of an electrically insulating extension sleeve engages with the annular lip portion of the cup-shaped body of the inventive terminal assembly, the extension sleeve in the embodiment of FIGS. 1-3 being symmetrical to have substantially identical opposed end portions; and, FIG. 4 is a view similar to FIG. 3 disclosing a modified extension sleeve and pin arrangement to illustrate another embodiment of the present invention.

As can be seen in FIGS. 1-3, the inventive hermetic terminal assembly, broadly indicated by reference numeral 2, includes a cover member in the form of cup-shaped body 3, advantageously of cold rolled steel, which can have a generally flat bottom 4 and side wall 6 with outwardly flaring rim 7. Bottom 4 has a dish or inner surface 8, an outside surface 9 and at least one hole or opening 11 defined by annular sealing lip 12 extending from inner surface 8 of bottom 4. Lip 12 includes an inner wall surface 13 and an extremity or end portion 14, details of which extremity are described hereinafter and can be more fully seen and understood in enlarged FIG. 3 of the drawings. As can be seen in FIG. 2 of the drawings, cup-shaped body 3 is, in fact, provided with three openings 11, all of which can incorporate similar annular sealing lips, pins and sleeve arrangements as hereinafter described.

As can be seen in FIG. 1, extending through each hole 11 is current conducting pin 16. Each pin 16 includes an outer end 17 which extends externally of cup-shaped body 3 and, of course, externally of the motor unit housing (not shown) which is provided with an opening to which the terminal unit assembly can be mounted (not illustrated). Each pin 16 further includes inner end 18, which extends beyond sealing lip 12, and which serves to receive an electrical connection in the housing to which assembly 2 is mounted.

Conducting pin 16, which can be of straight form as shown in FIGS. 1–3 or which can be provided with a flange (FIG. 4), extends through hole 11, defined by annular sealing lip 12, the pin being of less cross-sectional diameter than such hole. Advantageously, pin 16 can be formed from a suitable stainless steel with a high chromium content to enhance the bonding process of the pin to the sealing insulator 19, which can be of a suitable glass and which is heat softened in an oven in the bonding process. Sealing insulator 19 serves to receive and bond in place the extremity of the nesting end portion of a hollow electrically insulating extension sleeve 20 (FIGS. 1–3). Extension sleeve 20, which can be in the form of an annulus, can be of a suitable ceramic such as alumina or steatite and, in accordance with the present invention, the end portion thereof is sized and configured in a special manner with respect to the end portion 14 of annular sealing lip 12 against which it is sized and configured to abut.

Referring particularly to the enlarged embodiment of the terminal assembly 2 as illustrated in FIG. 3 of the drawings, it can be seen that extension sleeve 20 has an end portion 21 which is sized and geometrically configured in the form of a truncated cone to nest with the hole 11 determined by the annular lip 12. It is to be noted the outer side wall 22 of end or truncated cone portion 21 of sleeve 20 tapers inwardly toward the extremity of the truncated cone to abuttingly contact the extremity of end portion 14 of annular sealing lip 12. Advantageously the angle of taper can be approximately 45° to a plane through the flat extremity of the truncated conical end portion 22. The extremity of end portion 14 of annular lip 12 tapers inwardly in a directionally similar fashion as the tapering of outer wall 22 of truncated conical end portion 21 of sleeve 20 but at a different and greater angle of taper which advantageously can be at an angle of approximately 53° relevant the same plane or, in other words, a difference of taper relative the same plane of approximately 8°. As a consequence of this difference of taper, extension sleeve 20 contacts annular lip 12 along the outer periphery of end portion 14 of annular lip 12. Sealing insulator 19, which, as aforenoted, can be of a suitable glass insulating material, occupies the remaining space between the nesting end portion 21 of extension sleeve 20 and the end portion 14 of annular sealing lip 12, the glass sealing insulator extending between the peripheral body of pin 16 and the inner wall 13 of annular lip 12. As can be seen at reference numeral 23, the inner diameter of sleeve 20 can be greater than the diameter of pin 16 to provide an annular passageway therebetween to receive sealing insulator 19, further embedding and bonding extension sleeve 20 in seal 19. It is to be noted in FIG. 3 that the opposite end portions 21 of extension sleeve 20 advantageously can be of similar size and geometric configuration in the form of a truncated cone so that the sleeve 20 is generally symmetrical, allowing either end portion 21 of extension sleeve 20 to abuttingly engage end portion 14 of annular lip 12 only along the outer periphery thereof in substantial line contact therewith to thus localize possible cracking of the sealing insulator 19 which might occur along the line of contact of the extension sleeve with annular lip 12 to a position remote from pin 16. It further is to be understood that it also would be possible to make the opposed ends of extension sleeve 20 of different angular shapes —appropriately sloped and identified at either end, to engage with different cup-shaped bodies.

Figure 4:
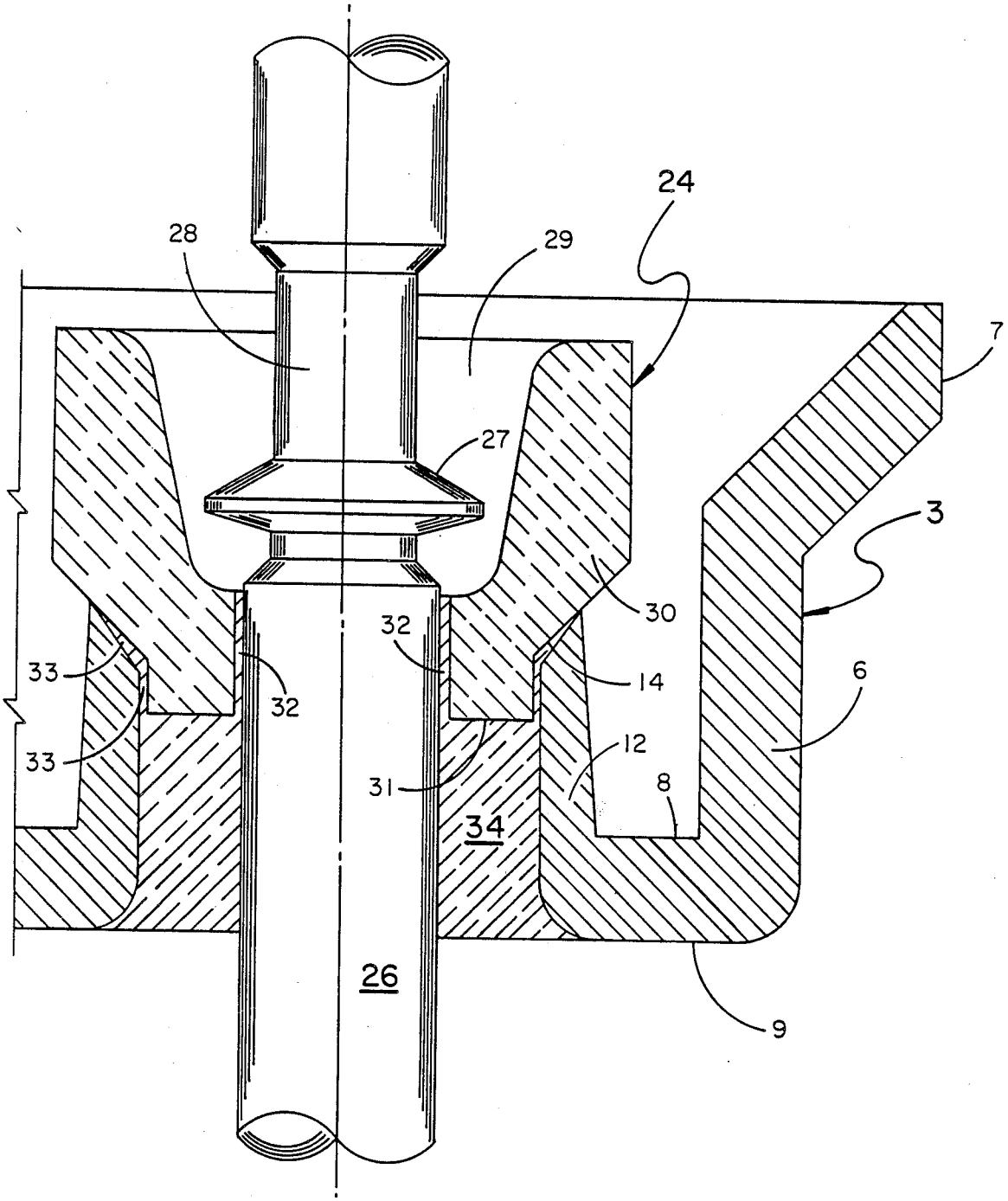

Referring to FIG. 4, the inventive hermetic terminal assembly is shown as employed with an identically contoured cup-shaped body 3 but with an insulating extension sleeve 24 and pin 26 similar to that disclosed in the abovementioned U.S. Pat. No. 4,584,433 wherein pin 26 includes a radial flange 27 and a reduced fuse portion 28, the inner portion of extension sleeve 24 being contoured with a recess 29 sized to accept flange 27 in spaced relation therefrom and the inner wall of the truncated portion 30, which includes a cylindrical end portion 31, being spaced from pin 26 to provide an annular space 32 therebetween. This space 32, along with space 33 formed by the differing slopes between the outer side of truncated portion 30 and end portion 14 of cup-shaped body 3, serves to enhance the bonding and embedding of sleeve 24 into sealing insulator 34. It is to be understood that it also would be possible to utilize a pin in the present invention which would not include a reduced fuse portion such as 28, the pin being of uniform diameter throughout except for an extending radial flange similar to flange 27 as disclosed.

From the above, it can be seen that hermetic terminal assembly structure is provided which is straightforward, efficient and economical in both manufacture and assembly.

The invention claimed is:

1. A hermetic terminal assembly adapted to be secured to an opening in a motor unit housing comprising:

a cup-shaped body with a bottom and a rim extending in one direction from said bottom, said bottom having at least one hole in it defined by an annular sealing lip projecting in the same direction as said rim;

a current conducting pin extending through said hole, said pin having an outer end to extend externally of said housing to receive an electrical connection to a current source and an inner end to receive an electrical connection disposed in said housing;

a sealing insulator bonding said pin to the inside surface of said lip; and, an electrically insulating extension sleeve surrounding said pin with an end portion thereof cooperating with said hole defined by said annular lip to engage with and be bonded to said sealing insulator, said end portion of said extension sleeve and the end portion of said annular lip being so sized and geometrically configured that the outer wall of said extension sleeve abuttingly engages said end portion of said annular lip only along the outer periphery thereof in substantial line contact therewith, thereby localizing any cracking of said sealing insulator which might occur from the abutting contact of said extension sleeve with said lip to a position remote from said conducting pin.

2. The hermetic terminal assembly of claim 1, said sealing insulator occupying the remaining space between said end portion of said extension sleeve and said end portion of said annular lip.

3. The hermetic terminal assembly of claim 1, said extension sleeve being sized relative the outer periphery of said terminal pin to provide an annular space therebetween with said sealing insulator occupying at least a portion of said annular space therebetween.

4. The hermetic terminal assembly of claim 1, said extension sleeve having opposed end portions which are similarly preselectively sized and geometrically configured so that either of said end portions of said extension sleeve can abuttingly engage said end portion of said annular lip only along the outer periphery thereof in substantial line contact therewith.

5. The hermetic terminal assembly of claim 1, said extension sleeve having opposed end portions which are differently preselectively sized and geometrically configured so that said end portions can engage with end portions of differing annular lips along the outer peripheries thereof in substantial line contact therewith.

6. The hermetic terminal assembly of claim 1, said end portion of said extension sleeve bonded to said sealing insulator being in the form of a truncated cone to provide an outer wall which axially tapers inwardly at a preselected angle toward the extremity thereof and said end portion of said annular lip axially tapering inwardly in a directionally similar fashion at a preselected angle larger than the angle of taper of said end portion of said extension sleeve thereby effecting said substantial line contact along the outer periphery of said end portion of said annular lip.

7. The hermetic terminal assembly of claim 6, the outer wall of said truncated cone axially tapering inwardly at an angle of approximately 45° and said end portion of said annular lip axially tapering inwardly at an angle of approximately 53°.

8. The hermetic terminal assembly of claim 6, the angle of taper of said annular lip being approximately 8° larger than the angle of taper of said end portion of said extension sleeve.

9. A hermetic terminal assembly adapted to be secured to an opening in a motor unit housing comprising:

a metallic cup-shaped body with a bottom and a rim extending in one direction from said bottom, said bottom having at least one hole in it defined by an annular sealing lip projecting in the same direction as said rim;

a stainless steel current conducting pin extending through said hole, said pin having an outer end to extend externally of said housing to receive an electric connection to a current source and an inner end to receive an electrical connection disposed in said housing;

a glass sealing insulator bonding said pin to the inside surface of said lip; and an electrically insulating ceramic extension sleeve surrounding said pin including an end portion in the form of a truncated cone terminating in a cylindrical end nesting with the hole determined by said annular sealing lip in annular spaced relation from said pin, the outer side wall of said truncated cone tapering inwardly toward said cylindrical end at an angle of approximately 45° to said cylindrical end to abuttingly contact the end portion of said annular sealing lip which tapers inwardly in a directionally similar fashion but at a greater angle of taper of approximately 53° to make substantial line contact along the outer periphery of said end portion of said annular lip with said glass sealing insulator occupying the remaining space between said nesting portion of said extension sleeve and said annular lip and at least a portion of the annular space between said extension sleeve and said pin, whereby said extension sleeve is embedded in said glass sealing insulator to localize any cracking of said glass sealing insulator which might occur adjacent the abutting contact of said sleeve with said lip to a position remote from said terminal pin.

10. The hermetic terminal assembly of claim 9, said conducting pin having a radially extending flange at the inner end thereof and said extension sleeve being recessed to accommodate said flange in spaced relation therewith.

* * * * *